US010472151B2

(12) United States Patent
Ball et al.

(10) Patent No.: US 10,472,151 B2
(45) Date of Patent: Nov. 12, 2019

(54) ARTICLE CARRIER AND BLANK THEREFOR

(71) Applicant: WestRock Packaging Systems, LLC, Atlanta, GA (US)

(72) Inventors: Nathaniel B. Ball, Richmond, VA (US); David T. Hayslette, Midltothian, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/750,380

(22) PCT Filed: Aug. 11, 2016

(86) PCT No.: PCT/US2016/046471

§ 371 (c)(1),
(2) Date: Feb. 5, 2018

(87) PCT Pub. No.: WO2017/027661

PCT Pub. Date: Feb. 16, 2017

(65) Prior Publication Data

US 2018/0222649 A1 Aug. 9, 2018

Related U.S. Application Data

(60) Provisional application No. 62/203,425, filed on Aug. 11, 2015.

(51) Int. Cl.
*B65D 71/58* (2006.01)

(52) U.S. Cl.
CPC .. *B65D 71/0022* (2013.01); *B65D 2571/0045* (2013.01); *B65D 2571/0066* (2013.01); *B65D 2571/00141* (2013.01); *B65D 2571/00388* (2013.01); *B65D 2571/00475* (2013.01); *B65D 2571/00524* (2013.01)

(58) Field of Classification Search
CPC .. B65D 71/00; B65D 71/003; B65D 71/0022; B65D 71/0029
USPC ..... 206/194
See application file for complete search history.

(56) References Cited

U.S. PATENT DOCUMENTS 2,182,065 A * 12/1939 Warren ..... B65D 71/0055 206/142
2,522,950 A * 9/1950 Keith ..... B65D 71/0037 206/143
2,563,065 A * 8/1951 Price ..... B65D 71/0051 206/171
2,712,397 A * 7/1955 Kowal ..... 206/163
2,984,383 A * 5/1961 Arneson ..... B65D 71/0022 206/184
3,780,906 A * 12/1973 Katzenmeyer ..... B65D 71/004 206/170

(Continued)

*Primary Examiner* — Steven A. Reynolds
*Assistant Examiner* — Javier A Pagan
(74) *Attorney, Agent, or Firm* — WestRock Intellectual Property Group

(57) ABSTRACT

Aspects of the disclosure relate to an article carrier having a carrying handle formed within a medial partition structure. The carrying handle (H) has an engaging edge that is disposed at a non-zero angle relative to an upper edge of the medial partition structure, and the engaging edge is disposed in an off-centre position within the medial partition structure.

16 Claims, 9 Drawing Sheets

(56) References Cited

U.S. PATENT DOCUMENTS 5,624,024 A * 4/1997 Miess ..... B65D 71/004
206/172

* cited by examiner

ARTICLE CARRIER AND BLANK THEREFOR

CROSS-REFERENCE TO RELATED APPLICATIONS

This application is a National Phase application of PCT Application PCT/US2016/046471, filed Aug. 11, 2016, which claims the benefit of US Provisional Patent Application No. 62/203425, filed Aug. 11, 2015, both of which are incorporated herein by reference in their entirety.

TECHNICAL FIELD

The present invention relates to a carrier and to a blank for forming the carrier. More specifically, but not exclusively, the invention relates to a carrier of the basket-style wherein a medial partition divides the carrier into at least two cells, wherein a carrying handle is provided which facilitates the withdrawal of the basket-style carrier from a store shelf in a retail outlet.

BACKGROUND

In the field of packaging it is known to provide basket style article carriers for carrying multiple articles. Basket style article carriers are well known in the art and are useful for enabling consumers to transport, store and access a group of articles for consumption. These carriers typically have a handle on top, such that the carrier mimics a conventional basket, and typically include a riser or medial partition from which the handle is fashioned. Such a handle placement can make it awkward for a consumer to grasp the carrier for removing the carrier from a shelf. Although consumers may appreciate basket-style article carriers for their convenience of carrying, their carrying comfort is not fully ergonomic and could be improved. Therefore, there exists a need for a basket-style article carrier that is more readily removable from a store shelf. It may be desirable for the basket-style article carrier to be stackable when loaded yet still convenient for the consumer to carry. For cost and environmental considerations, such cartons or carriers need to be formed from as little material as possible and cause as little wastage in the materials from which they are formed as possible. Further considerations are the strength of the carrier; its suitability for holding and transporting large weights of articles; and the aesthetic appeal of the carrier which, if eye-catching and appealing to a consumer, may promote increased sales.

The present invention seeks to provide an improvement in the field of basket-style article carriers, typically formed from paperboard or the like.

SUMMARY

According to a first aspect of the present invention there is provided an article carrier, comprising: a tubular structure having a plurality of outer walls defining an interior volume for receiving one or more articles; a medial partition structure connected to the tubular structure; and a carrying handle formed in the medial partition structure, the carrying handle having an engaging edge, the engaging edge being disposed in an off-centre position within the medial partition structure and the engaging edge being disposed at a non-zero angle relative to an upper edge of the medial partition structure. In this way the carrying handle can be more easily grasped from one end when the carrier is first removed from a store shelf and yet when the carrier is lifted, the carrier is titled so that it is balanced and comfortable to carry, even though the handle is off-centre.

Optionally, the carrying handle comprises at least one aperture, which aperture defines said engaging edge, and wherein a first notional line passing through the centre of said at least one aperture is spaced from a second notional line passing through a centre of the medial partition structure such that the engaging edge is disposed in said off-centre position within the medial partition structure.

Optionally, the second notional line also passes through an end region of the at least one aperture such that the at least one aperture is dimensioned to extend between the first notional line and the second notional line.

Optionally, the carrier comprises a bottom wall and the first and second notional lines each run in a perpendicular manner to the bottom wall.

Optionally, the plurality of outer walls comprises first and second opposed side walls and front and rear opposed end walls, and wherein a first end of the carrying handle is closer to the front end wall than a second end of the carrying handle is to the rear end wall.

Optionally, the medial partition structure has an end-to-end length and wherein the distance between the first end of the carrying handle and the second end of the carrying handle is between about 40% and about 45% of the end-to-end length of the medial partition structure.

Optionally, a first distance between the front end of the carrier and the first end of the carrying handle 'H' is between about 10% and about 15% of the end-to-end length of the medial partition structure.

Optionally, a second distance between the rear end of the carrier and the second end of the carrying handle is between about 40% and about 45% of the end-to-end length of the medial partition structure.

Optionally, the second distance is about 45% of the end-to-end length of the medial partition structure.

Optionally, a third distance between the second notional mid-line of the carrier and the first notional mid-line of the carrying handle is between about 10% and about 15% of the end-to-end length of the medial partition structure.

Optionally, the third distance is 13% of the end-to-end length of the medial partition structure.

Optionally, the non-zero angle at which the engaging edge of the carrying handle is disposed, relative to the upper edge of the medial partition structure is between about 5° and about 15°.

Optionally, the non-zero angle is 10°.

Optionally, the medial partition structure is arranged to divide the interior of the carrier into at least two cells.

Optionally, the carrier comprises partition structures and wherein the interior volume is divided into separate cells created by the partition structures, which partition structures mitigate against the articles contained within the carrier from colliding into one another.

Optionally, the carrying handle comprises one or more cushioning flaps foldably connected to the carrying handle and wherein at least one cushioning flap is foldably connected along the engaging edge to provide a cushion against which a user's fingers more comfortably contact the carrying handle when the carrying handle is deployed.

Optionally, the carrying handle is sufficiently large such that at least three of a user's fingers can be inserted into the carrying handle and the medial partition structure comprises only one such carrying handle.

In some embodiments, the carrying handle comprises a handle aperture extending through medial partition structure, the handle aperture having a first and second end and wherein the partition structures comprises a first pair of cells for receiving a respective one of a first pair articles and a second pair of cells for receiving a respective one of a second pair articles, the first pair of cells being disposed at an end of the article carrier and the second pair of cells disposed adjacent to the first pair of cells, and wherein the handle aperture is arranged to be disposed between the first pair of articles and between the second pair of articles and extends therebetween.

According to another aspect of the invention for which protection is sought, there is provided a blank for forming an article carrier, the blank comprising: a plurality of panels for forming a plurality of outer walls of a tubular structure of the carrier; one or more panels for forming a medial partition structure, which one or more panels are configured and arranged such that once the blank is assembled into a carrier, the medial partition structure is connected to the tubular structure and is disposed to divide the interior of the carrier into at least two cells; and wherein the one or more panels for forming a medial partition structure comprise handle features for forming a carrying handle in the medial partition structure, the features for forming a carrying handle being configured and arranged such that the carrying handle of the carrier formed from the blank has an engaging edge that is disposed at a non-zero angle relative to an upper edge of the medial partition structure and wherein the engaging edge is disposed in an off-centre location within the medial partition structure.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
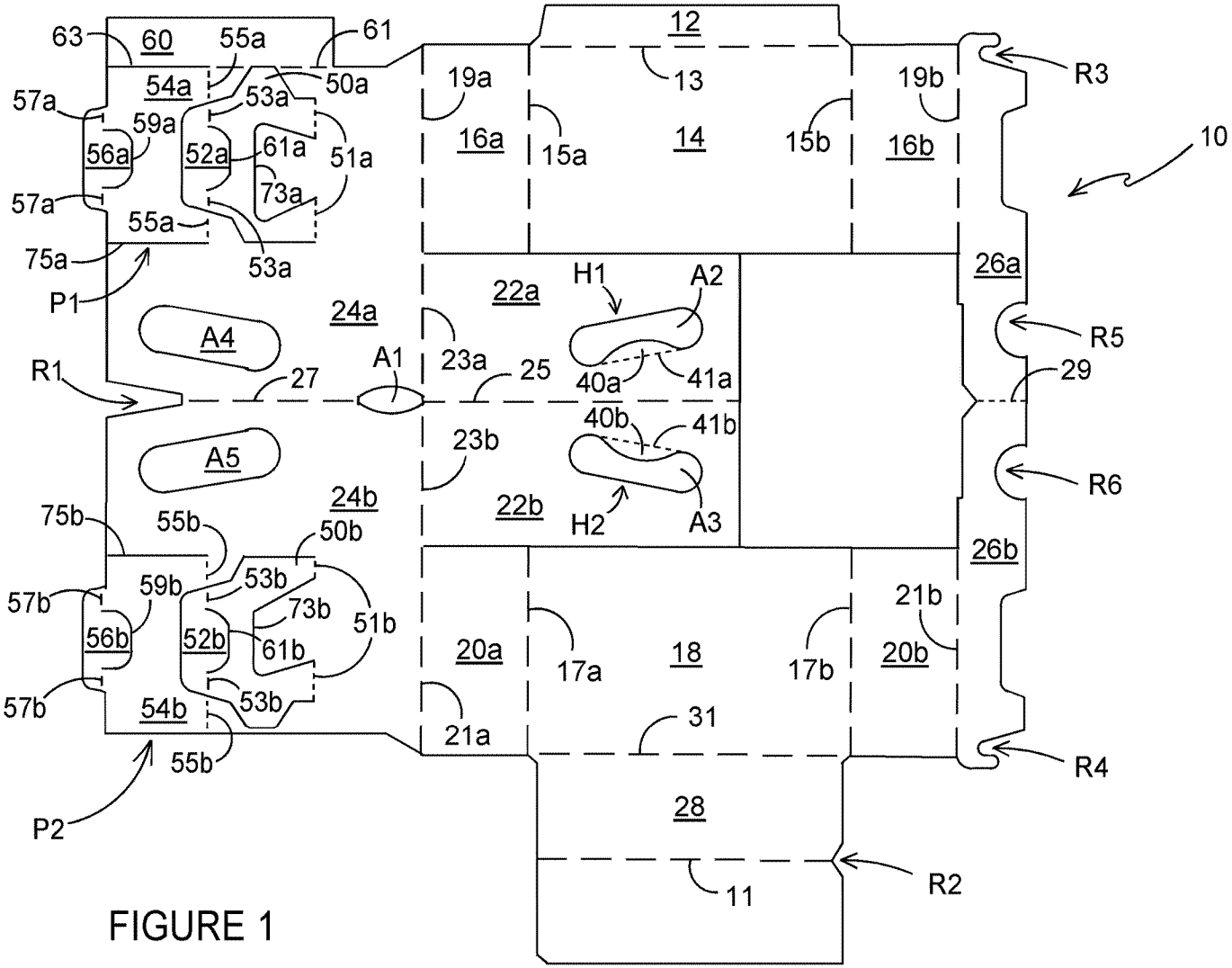
FIG. 1 is a plan view from above of a blank for forming a carrier according to a first embodiment.
Figure 7:
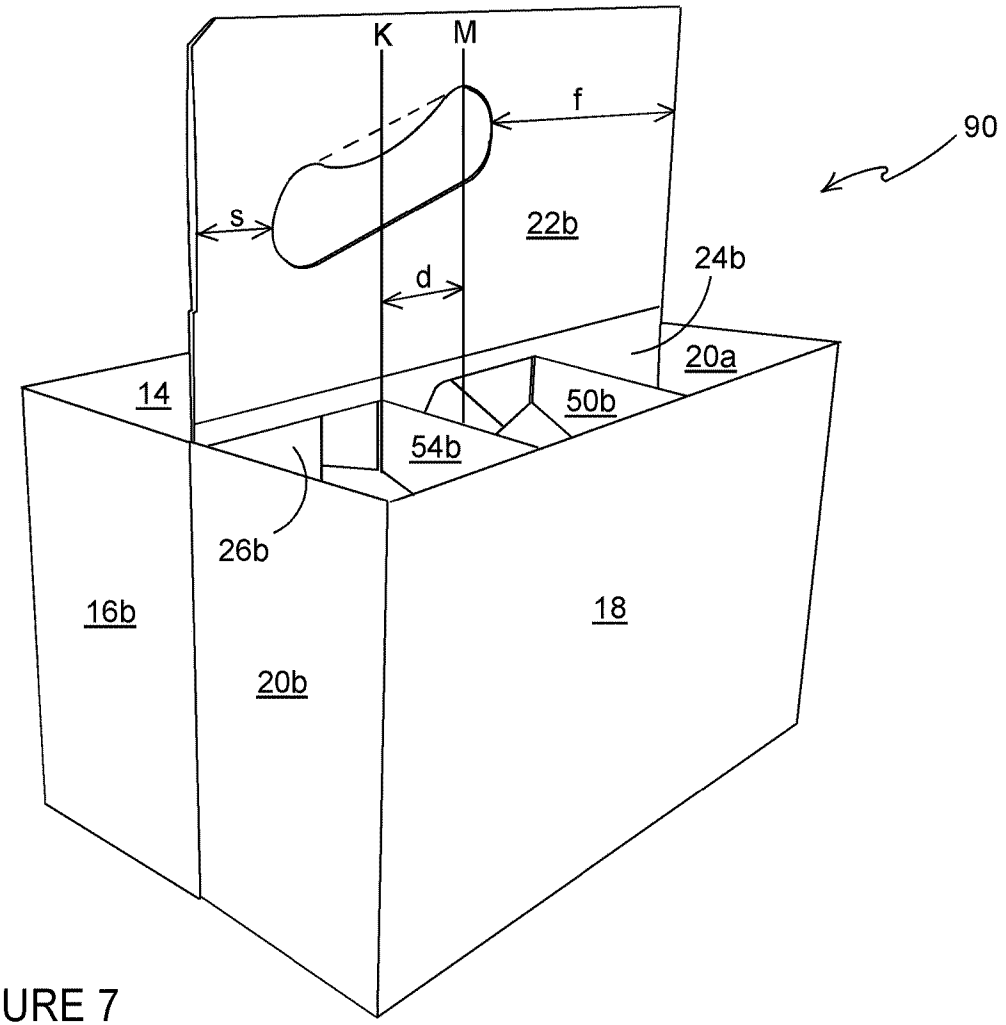
FIG. 7 is a perspective view from above of a front end wall and a first side of a carrier formed from the blank of FIG. 1.
Figure 8:
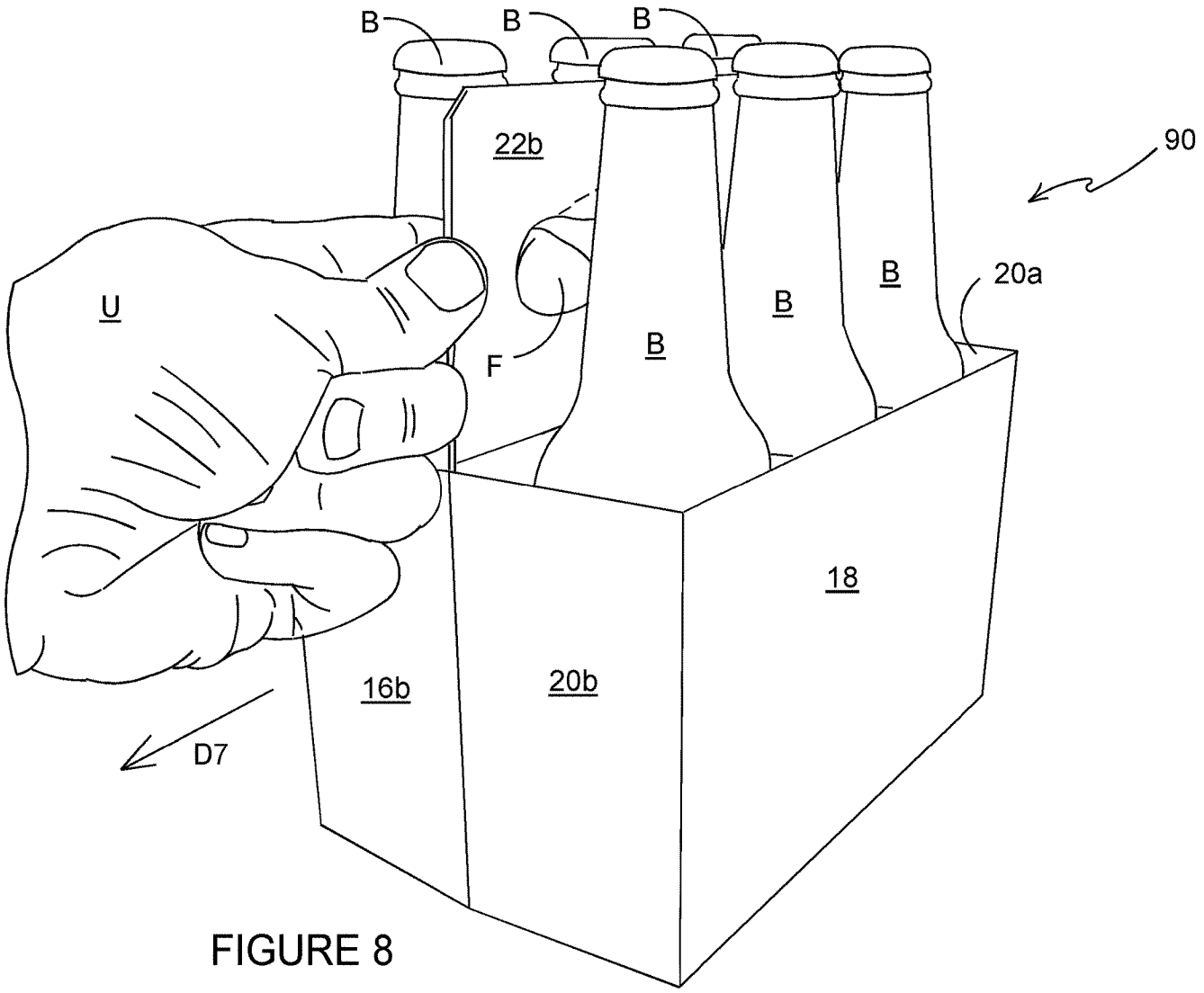
FIG. 8 is an alternative perspective view from above of the carrier of FIG. 7.
Figure 9:
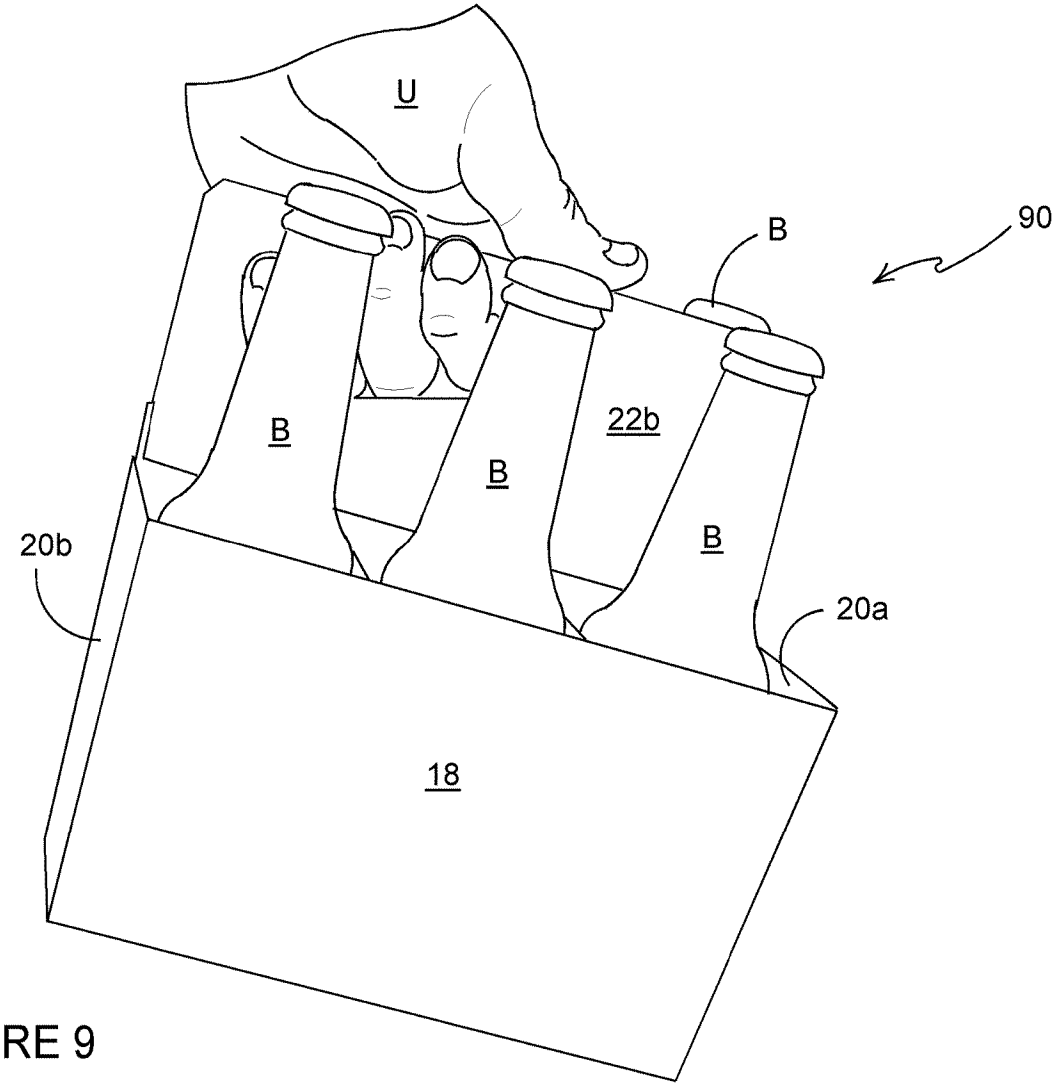
FIG. 9 is a perspective view of a carrier formed from the blank of FIG. 1 being carried by a carrying handle.

Referring to FIG. 1, there is shown a plan view of a blank 10 capable of forming a carton or carrier 90 having a carrying handle 'H', as shown in FIGS. 7, 8 and 9, for containing and carrying a group of primary products 'B', such as, but not limited to, cans or bottles, hereinafter referred to as articles 'B'.

In the embodiments detailed herein, the terms "carton" and "carrier" refer, for the non-limiting purpose of illustrating the various features of the invention, to a container for engaging and carrying articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

In the illustrated embodiment, the blank 10 is configured to form a carton or carrier 90 for packaging an exemplary arrangement of exemplary articles. In the illustrated embodiment, the arrangement is a 2×3 matrix or array and the articles 'B' are bottles 'B'. Alternatively, the blank 10 can be configured to form a carrier for packaging other types, number and size of articles and/or for packaging articles in a different arrangement or configuration.

Referring to FIG. 1, the blank 10 comprises a plurality of main panels **16*b*, 14, 16*a*, 20*b*, 18, 20*a* for forming outer walls of a basket-style carrier 90 (see FIG. 7). The plurality of main panels includes a first side panel 18 and a second side panel 14. The second side panel 14 is hinged at a first end to a second end panel 16*b* by a hinged connection such as a fold line 15*b*. The first side panel 18 is hinged at a first end to a first end panel 20*b* by a hinged connection such as a fold line 17*b*. The first side panel 18 is hinged at a second end to a third end panel 20*a* by a hinged connection such as a fold line 17*a*. The second side panel 14 is hinged at a second end to a fourth end panel 16*a* by a hinged connection such as a fold line 15*a***.

The blank 10 comprises a base panel 28, optionally hinged to the first side panel 18 by a hinged connection such as a fold line 31. A securing panel 12 is hinged to the second side panel 14 by a hinged connection such as a fold line 13.

The first end panel **20*b* and the second end panel 16*b* together form a first end wall of the carrier 90. The third end panel 20*a* and the fourth end panel 16*a* together form a second end wall of the carrier 90**.

The blank 10 comprises a first riser panel **26*a* hinged to the second end panel 16*b* by a hinged connection such as a fold line 19*b*. The blank 10** comprises a second riser panel

26*b* hinged to the first end panel 20*b* by a hinged connection such as a fold line 21*b*. The first riser panel 26*a* is hinged to the second riser panel 26*b* by a hinged connection such as a fold line 29. Together the first and second riser panels 26*a*, 26*b* assist in coupling the first end panel 20*b* to the second end panel 16*b* to form the first composite end wall 16*b*/20*b* when the blank 10 is assembled. The first riser panel 26*a* comprises a first recess R3 which is configured to form a hook-like projection on a side edge thereof. The second riser panel 26*b* comprises a second recess R4 which is configured to form a hook-like projection on a side edge thereof.

Upper portions of the first and second riser panels 26*a*, 26*b* form inner parts of the carrying handle structure 'H'. Further recesses or cutouts R5, R6 are provided along the free edge of the first and second riser panels 26*a*, 26*b*, which cutouts R5, R6 are shaped and sized in complementary manner and for assembling with a carrying handle structure 'H'.

The base panel 28 comprises a hinged connection such as a fold line 11 which extends longitudinally thereacross so as to longitudinally divide the base panel 28. The base panel 28 comprises a further recess R2 struck from a first end edge thereof; the fold line 11 extends from the further recess R2. The further recess R2 is configured to form a notch for interlocking with the hook-like projections formed in the first riser panel 26*a* and the second riser panel 26*b*.

The first and second side panels 18, 14 are spaced apart; the third end panel 20*a* and the fourth end panel 16*a* are spaced apart; and between them, there is provided a first handle reinforcing panel 22*a*; and a second handle reinforcing panel 22*b*. The first handle reinforcing panel 22*a* is hinged to a first handle panel 24*a* along part of a hinged connection such as a fold line 23*a*. The second handle reinforcing panel 22*b* is hinged to a second handle panel 24*b* along part of a hinged connection such as a fold line 23*b*. The fourth end panel 16*a* is hinged to the first handle panel 24*a* along a hinged connection such as a fold line 19*a*. The third end panel 20*a* is hinged to the second handle panel 24*b* along a hinged connection such as a fold line 21*a*.

The first handle reinforcing panel 22*a* is hinged to the second handle reinforcing panel 22*b* by a hinged connection such as a fold line 25. The first handle panel 24*a* is hinged to the second handle panel 24*b* along by a hinged connection such as a fold line 27. A recess R1 and an aperture A1, disposed in line with fold line 27 serve to minimize the amount of material present around the fold line 27.

In the illustrated arrangement, the carrying handle structure H optionally comprises a first handle aperture A2 struck from the first handle reinforcing panel 22*a*; a second handle aperture A3 struck from the second handle reinforcing panel 22*b*; a third handle aperture A4 struck from the first handle panel 24*a*; and a fourth handle aperture A5 struck from the second handle panel 24*b*. Additionally cushioning flaps 40*a*, 40*b*, are hinged to the first and second handle reinforcing panels 22*a*, 22*b* by hinged connections such as fold lines 41*a*, 41*b* and are formed about the first handle aperture A2 and the second handle aperture A3 respectively. The first and second handle apertures A2, A3 with their associated cushioning flaps 40*a*, 40*b* provide outermost handle apertures 'H1', 'H2' of the carrying handle structure 'H'.

As can be seen in FIG. 1, the handle apertures A2, A3, A4, A5 that form the carrying handle structure 'H' are each positioned non-centrally within the panel (22*a*, 22*b*, 24*a*, 24*b*) in which they are formed and are each positioned at a non-zero angle relative to a top or bottom edge (25, 27) of that panel (22*a*, 22*b*, 24*a*, 24*b*).

The blank 10 further comprises a plurality of partition structures. The partition structures are provided to divide the interior of the basket carrier 90 into separate cells. The cells may or may not be of uniform size and, optionally in the present arrangement, the partition structures together with the first and second handle panels 24*a*, 24*b* and first and second handle reinforcing panels 22*a*, 22*b* divide the interior of the basket carrier 90 into six cells arranged in two rows of three cells each.

The first partition structure P1 comprises a first partition panel 50*a* that is struck from material that would otherwise form part of the first handle panel 24*a* and is hinged thereto by a hinged connection such as an interrupted fold line 51*a*. Fold line 51*a* is interrupted by a cut line 73*a*. The first partition structure P1 comprises a securing flap 52*a* that is hinged to the first partition panel 50*a* by a hinged connection such as an interrupted fold line 53*a*. Fold line 53*a* is interrupted by a cut line 61*a*. A hinged connection such as a fold line 55*a* foldably connects the first handle panel 24*a* to a third partition panel 54*a*. The securing flap 52*a* is struck from material that would otherwise form part of the third partition panel 54*a* and is provided to affix the first partition panel 50*a* to the second side panel 14. The first partition structure P1 comprises the third partition panel 54*a* which is hinged by the fold line 55*a* to the first handle panel 24*a*. The first partition structure P1 comprises a third securing panel 56*a*, which is hinged to the third partition panel 54*a* by a hinged connection such as an interrupted fold line 57*a*. The fold line 57*a* is interrupted by outline 59*a* which defines part of the securing panel 56*a*. A cut line 75*a* separates the third partition panel 54*a* from the first handle panel 24*a*.

The second partition structure P2 comprises a second partition panel 50*b* that is struck from material that would otherwise form the second handle panel 24*b* and is hinged thereto by a hinged connection such as an interrupted fold line 51*b*. Fold line 51*b* is interrupted by a cut line 73*b*. The second partition structure P2 comprises a securing flap 52*b* that is defined in part by a cut line 61*b* and that is hinged to the second partition panel 50*b* by a hinged connection such as a fold line 53*b*. A hinged connection such as a fold line 55*b* foldably connects the first handle panel 24*b* to a fourth partition panel 54*b*. The securing flap 52*b* is struck from material that would otherwise form part of the fourth partition panel 54*b* and is provided to affix the second partition panel 50*b* to the first side panel 18. The second partition structure P2 comprises the fourth partition panel 54*b* which is hinged by the fold line 55*b* to the second handle panel 24*b*. The second partition structure P2 comprises a fourth securing panel 56*b*, which is defined in part by a cut line 59*b* and which is hinged to the fourth partition panel 54*b* by a hinged connection such as an interrupted fold line 57*b*. The fourth partition panel 54*b* is separated from the second handle panel 24*b* by a cut line 75*b*.

A fifth securing panel 60 is hinged by a hinged connection such as a fold line 61 to a bottom edge of the first handle panel 24*a*; and is separated by a cut line 63 from the third partition panel 54*a*.

Turning to the construction of the carrier 90 from the blank 10, glue or other adhesive treatment is applied in two regions on each of the inside surfaces of the first and second side panels 18, 14 respectively. The regions correspond to locations that the first securing panel 52*a*, second securing panel 52*b*, third securing panel 56*a* and fourth securing panel 56*b* will occupy once the blank 10 is folded.

Glue or other adhesive treatment may also be applied to the first and second handle reinforcing panels 22*a*, 22*b* in the region of the first and second handle apertures A2, A3.

Figure 2:
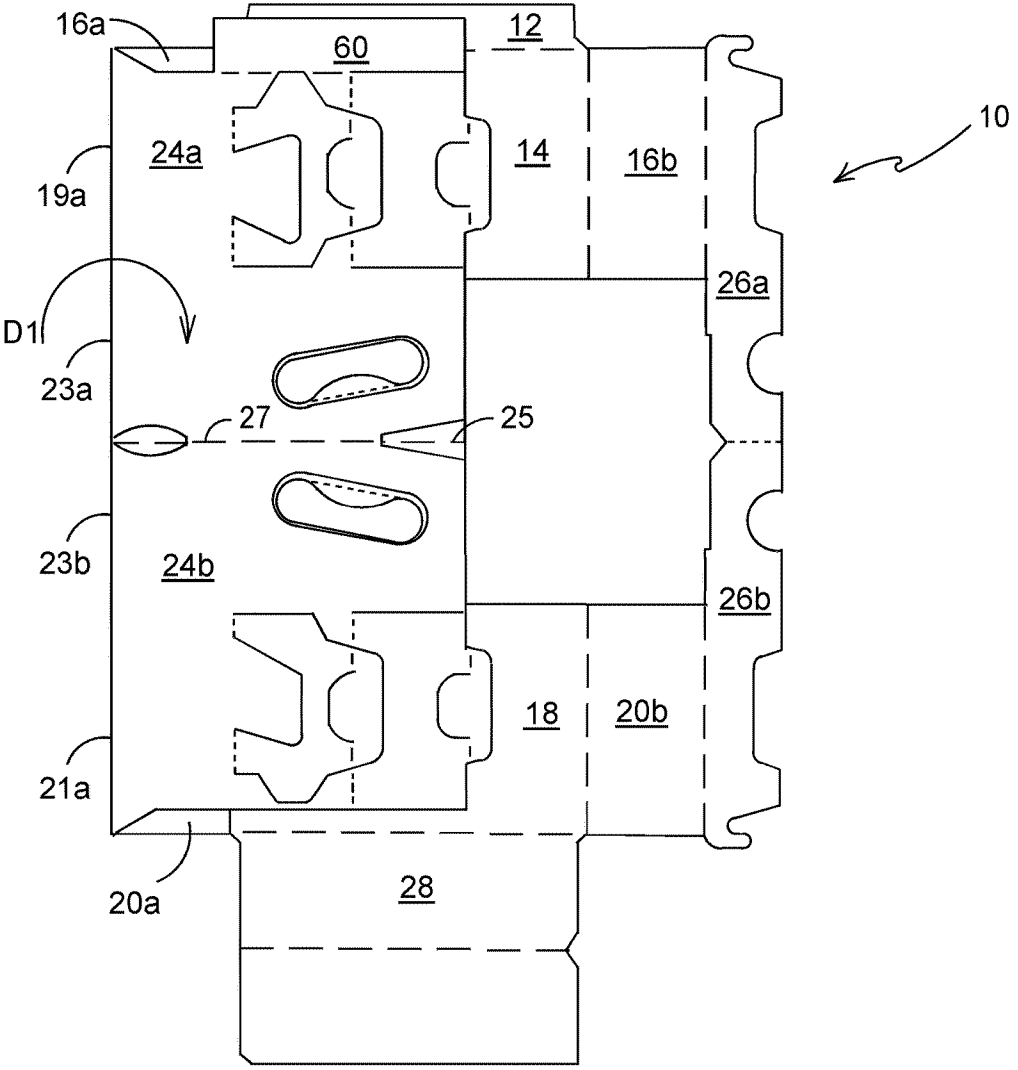
FIGS. 2 to 6 are plan views from above of the blank during sequential stages of construction of the blank of FIG. 1 into a carrier.

The blank 10 is then folded about the fold lines 19*a*, 21*a*, in the direction as indicated by arrow D1 in FIG. 2, to bring the first and second handle panels 24*a*, 24*b* into face contacting relationship with: the first and second handle reinforcing panels 22*a*, 22*b*; and the third and fourth end panels 16*a*, 20*a*. At the same time the four partition structures are manipulated such that the first and third partition panels 50*a*, 54*a* overlay the second side panel 14 and the securing flaps 52*a* and 56*a* are affixed to the second side panel 14. Similarly, the second and fourth partition panels 50*b*, 54*b* overlay the first side panel 18 and the securing flaps 52*b*, 56*b* are affixed to the first side panel 18.

Figure 3:
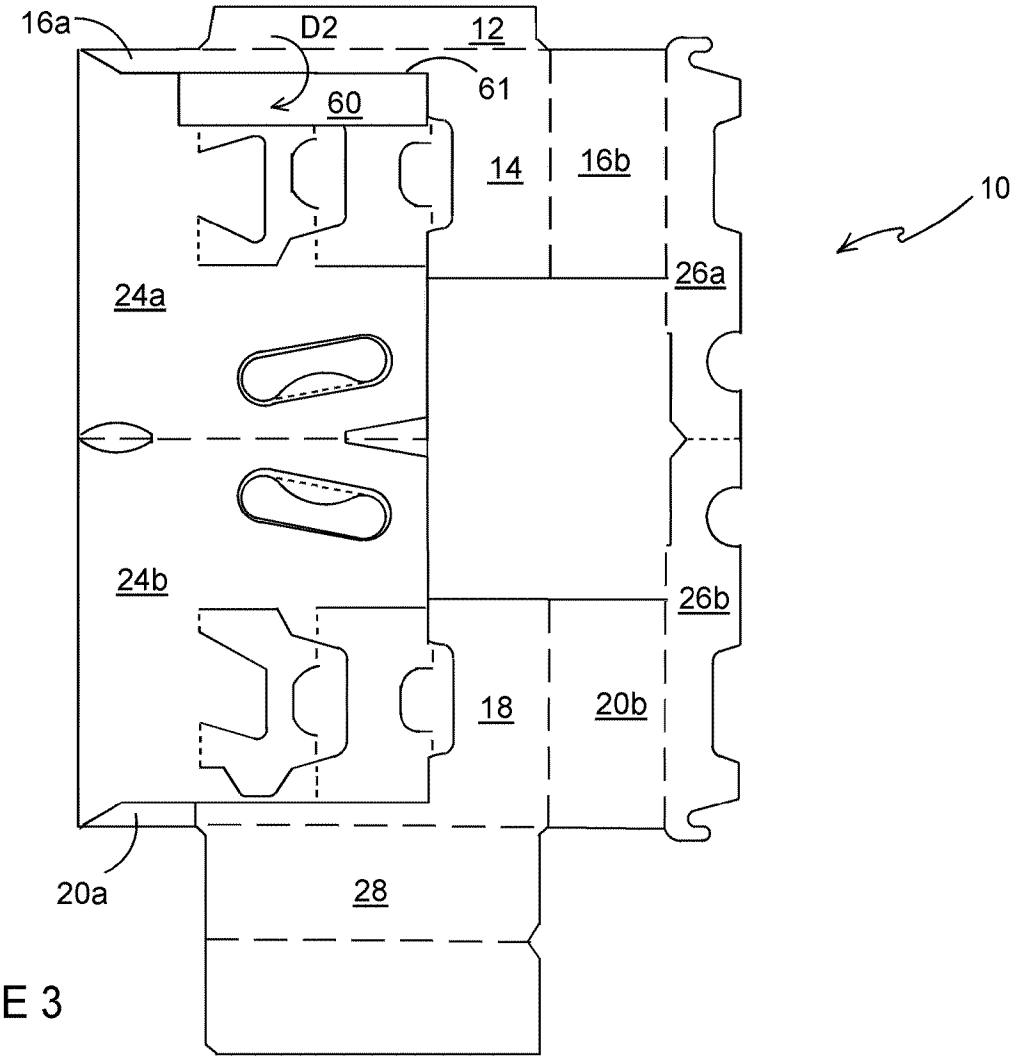
Figure 4:
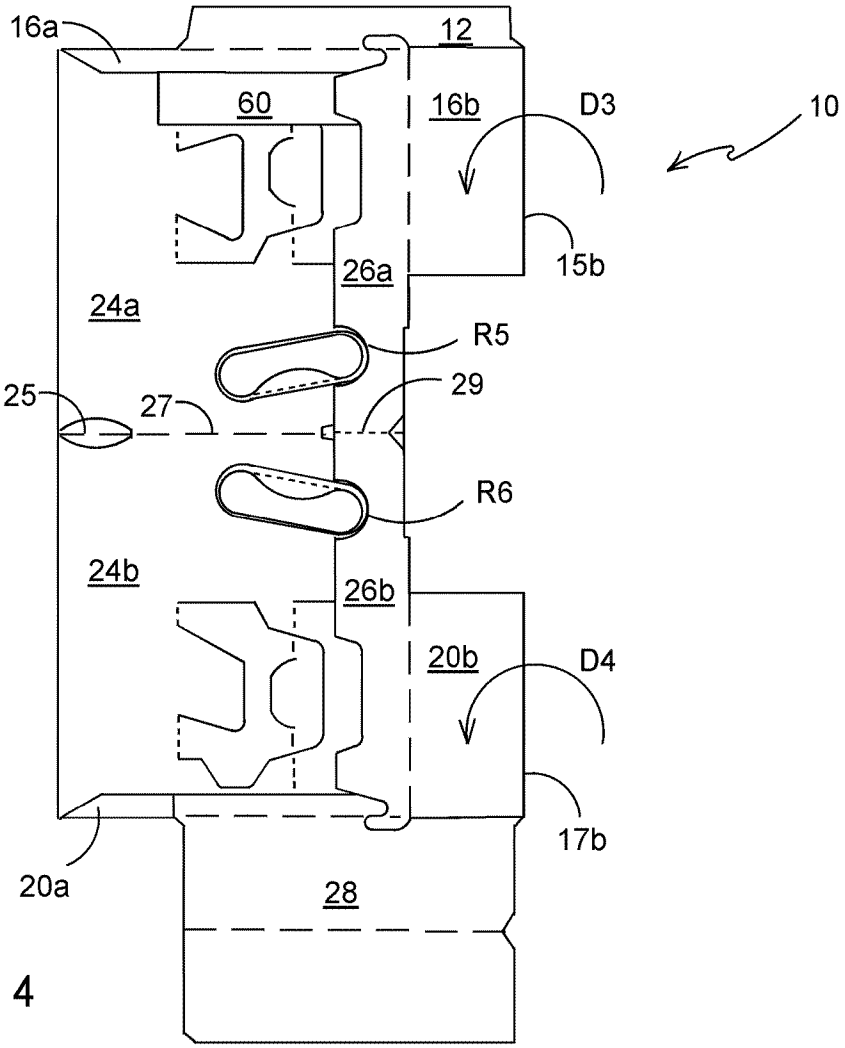
Figure 5:
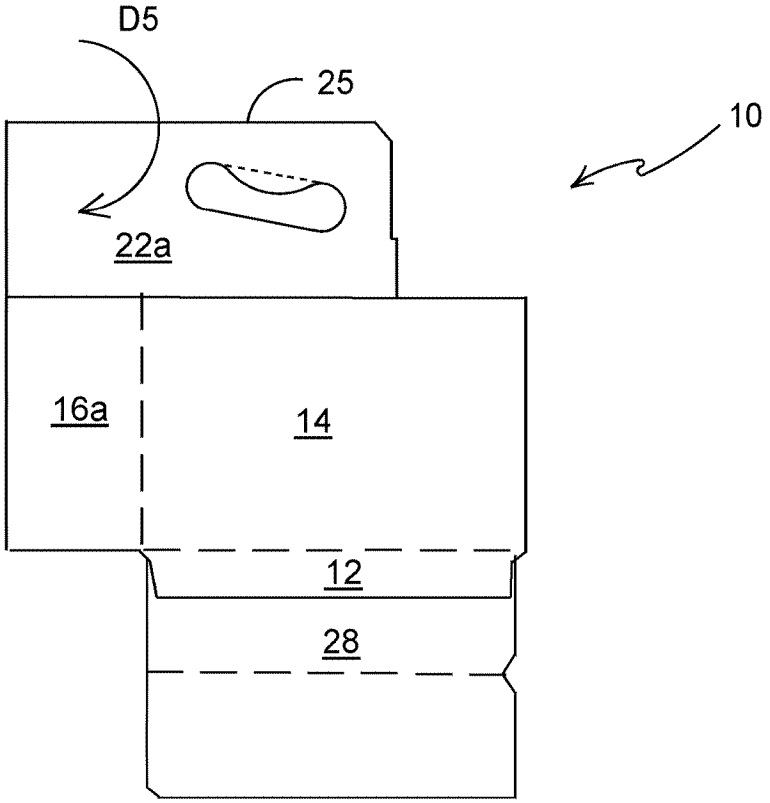
Figure 6:
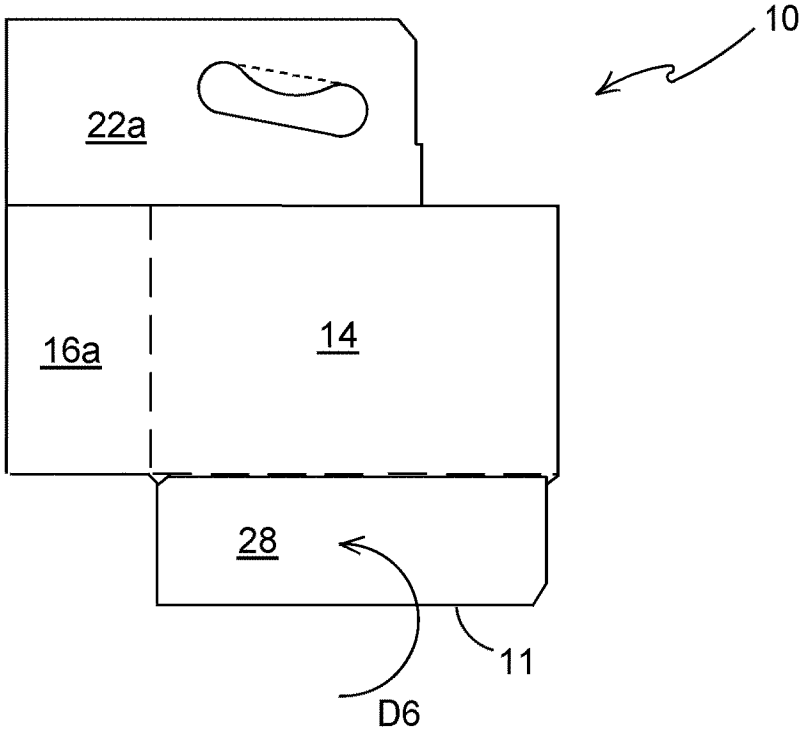

Glue or other adhesive treatment is applied to the upwardly facing surface of the first handle panel 24*a*, proximate to the fold line 61, and either side of first partition panel 50*a*. The fifth securing flap 60 is then folded, as shown by direction arrow D2 in FIG. 3, about the fold line 61 to bring the fifth securing flap 60 into overlapping relationship with the first handle panel 24*a* and part of the first and third partition panels 50*a*, 54*a*. In this way, the fifth securing flap 60 is secured only to the first handle panel 24*a*.

Glue or other adhesive treatment is appropriately applied such that when the first and second riser panels 26*a*, 26*b* are folded, as indicated by arrow D3, about fold lines 19*b*, 21*b*, the first and second riser panels 26*a*, 26*b* are affixed to the first and second handle panels 24*a*, 24*b*. First riser panel 26*a* is affixed to the fifth securing panel 60.

Glue or other adhesive treatment is then applied to the fifth securing panel 60 in readiness for affixing the fifth securing panel 60 to the second handle panel 24*b*.

Glue or other adhesive treatment is then applied to first and/or second handle panel 24*a*, 24*b*, in the area around the third and fourth handle apertures A4, A5 of the first handle panel 24*a* and second handle panel 24*b*.

Additional glue may optionally be applied to exposed parts of the second handle panel 24*b* and to second riser panel 26*b*. The blank 10 is then folded, as shown by arrow D5, about fold line 27 that hinges the first and second handle panels 24*a*, 24*b* together. Fold line 27 is interrupted by aperture A1 which is provided in order to reduce the amount of material present in that region. Once the blank 10 is folded the first and second handle panels 24*a*, 24*b* may be attached, thus forming the medial partition structure.

To complete the construction of the blank 10, glue or adhesive treatment is applied to securing panel 12 and the bottom panel 28 is folded about fold line 11 such that the securing panel 12 is attached to the bottom panel 28. The flat collapsed carrier thereby formed can be opened into a basket-style article carrier by separating the first and second side panels 18, 14. The partition structures are automatically erected when the flat collapsed carrier is opened out.

Once the carton 90 is erected, the first and second handle panels 24*a*, 24*b* and the first and second handle reinforcing panels 22*a*, 22*b* (along with first and second riser panels 26*a*, 26*b*) form a medial partition structure 22*a*/24*a*/24*b*/22*b* that is disposed medially and substantially within the interior of the carrier 90 formed by the outer shell panels 18, 20*b*, 16*b*, 14, 16*a*, 20*a*. The medial partition structure 22*a*/24*a*/24*b*/22*b* divides the interior of the carrier 90 into two separate cells. The first and second handle panels 24*a*, 24*b* and the first and second handle reinforcing panels 22*a*, 22*b* are disposed in a layered arrangement, with the first and second handle panels 24*a*, 24*b* sandwiched between the first and second handle reinforcing panels 22*a*, 22*b*. As such the first and second handle reinforcing panels 22*a*, 22*b*, with their associated cushioning flaps 40, 42, are disposed outermost.

As can be seen from FIGS. 7 to 9 the apertures A2, A3, A4, A5 have been located in an off-centre location within the medial partition structure (first and second handle reinforcing panels 22*a*, 22*b* and first and second handle panels 24*a*, 24*b*). The off-centre location of the carrying handle 'H' may make it easier for the carrier 90 to be withdrawn from a shelf in a retail outlet by a consumer 'U', when the carrier 90 is positioned with its front end wall 16*b*/20*b* facing toward the consumer 11'. This is because the carrying handle 'H' is located closer to that front end wall 16*b*/20*b*. This is illustrated in FIG. 8, wherein it can be seen that a first end of the carrying handle 'H', that is located close to the front end wall 16*b*/20*b* of the carrier 90, can be easily grasped by a user 'U', who can hook their finger 'F' into the front end of the carrying handle 'H', and withdraw the carrier 90 from a shelf (not shown) by pulling the carrier in the direction 'D7'.

Optionally, the off-centre location of the carrying handle 'H' may form part of or may enhance a branding feature, such as a slogan, graphic or other advertising gimmick. By off-centre, it is meant that a first notional line 'K' passing through the centre of the handle apertures A2, A3, A4, A5 is spaced from a second notional line 'M' passing through the centre of the medial partition structure 22*a*/24*a*/24*b*/22*b*. As illustrated in FIG. 7, the first notional line 'K' passing through the centre of the handle apertures A2, A3, A4, A5 is spaced, a third distance "d", from the second notional line 'M' passing through the centre of the medial partition structure 22*a*/24*a*/24*b*/22*b*.

Additionally, and as also shown in FIGS. 7 to 9 the apertures A2, A3, A4, A5 are angled, that is to say the apertures A2, A3, A4, A5 are disposed at a non-zero angle with respect to an upper edge of the medial partition structure 22*a*/24*a*/24*b*/22*b*. A first end of the handle structure 'H' may be considered as the end that is closest to the front end wall 16*b*, 20*b* of the carrier 90. As shown in FIG. 7, the first end of the carrying handle 'H' is spaced, by a first distance "s", from a front edge of the medial partition structure 22*a*/24*a*/24*b*/22*b*. A second end of the carrying handle 'H' may be considered as the end that is closest to the rear end wall 16*a*/20*a* of the carrier 90. As shown in FIG. 7, the second end of the carrying handle 'H' is spaced, by a second distance "f", from a rear edge of the medial partition structure 22*a*/24*a*/24*b*/22*b*. The second end of the handle structure 'H' is disposed at a higher elevation than the first end of the carrying handle 'H'. The angle may be selected in dependence upon how the centre of gravity of the carrier 90 is altered by positioning the first end of the apertures A2, A3, A4, A5 further from the mid-line 'M' than the second end. The angle may be about 10°. In known basket carriers, the handle apertures are typically oriented and positioned such that they run parallel to an upper edge of a medial partition structure and not, as introduced here, at a non-zero angle relative thereto.

However, in the present arrangement, by positioning the handle non-centrally (i.e. closer to the front end wall 16*b*/20*b* than to the rear wall 16*a*/20*a*), so that the carrier 90 may more easily be withdrawn from a shelf (if located front-end on), the centre of gravity of the carrier 90 is shifted away from the second notional centre line 'M'. By angling the handle apertures A2, A3, A4, A5 (and hence the upper engaging edge of the handle 'H') upwardly, the carrier 90 can be comfortably lifted and carried by a user (see FIG. 9).

As can be seen in FIG. 9, despite the off-centre location of the handle 'H', the angled form of the handle 'H' compensates for any imbalance in the centre of gravity when the carrier 90 is held and the carrier 90 is comfortably carried at a tilted angle, but in a balanced manner. In other words, when being carried (see FIG. 9), the plane of the bottom panel 28 is not parallel to the ground. The user can place the engaging edge of the carrying handle 'H', flat in their palm, and the carrier 90 can adopt a balanced, albeit tilted position (see FIG. 9). It can also be seen in FIG. 9 that the carrying handle 'H' is sufficiently large such that at least three of a user's fingers can be inserted into the carrying handle 'H'. The carrying handle 'H' being so, sufficiently large means that the medial partition structure comprises only one such carrying handle. The term "off-centre" may be taken to mean that any and all carrying handles and carrying handle apertures within the medial partition structure 22*a*/24*a*/24*b*/22*b* are asymmetric about the second notional line 'M' passing through the centre of the medial partition structure 22*a*/24*a*/24*b*/22*b*.

Optionally, in the present configuration the distance between the first end and the second end of the handle structure 'H' is between about 40% and about 45% of the overall end to end length of the first and second handle reinforcing panels 22*a*, 22*b*.

Optionally, the distance 's' between the front end of the carrier 90 and the first end of the carrying handle 'H' may be between about 10% and about 15% of the overall end to end length of the first and second handle reinforcing panels 22*a*, 22*b*. Optionally the distance 's' may be 12% of the overall end to end length of the first and second handle reinforcing panels 22*a*, 22*b*.

Optionally, the distance 'f' between the rear end of the carrier 90 and the second end of the carrying handle 'H' may be between about 40% and about 45% of the overall end to end length of the first and second handle reinforcing panels 22*a*, 22*b*. Optionally the distance 'f' may be 45% of the overall end to end length of the first and second handle reinforcing panels 22*a*, 22*b*.

Optionally, the distance 'd' between the notional mid-line 'M' of the carrier and the notional mid-line 'K' of the carrying handle may be between about 10% and about 15% of the overall end to end length of the first and second handle reinforcing panels 22*a*, 22*b*. Optionally, the distance 'd' may be 13% of the overall end to end length of the first and second handle reinforcing panels 22*a*, 22*b*.

The carrying handle of FIG. 7 comprises a handle aperture extending through the medial partition structure, the handle aperture has a first and second end. The partition structure comprises a first pair of cells for receiving a respective one of a first pair articles and a second pair of cells for receiving a respective one of a second pair articles, see FIG. 8. The first pair of cells is disposed at an end of the article carrier and the second pair of cells disposed adjacent to the first pair of cells. The handle aperture is arranged to be disposed between the first pair of articles and between the second pair of articles and extends therebetween.

Optionally, the articles comprise neck portions which are smaller in diameter, or width dimension, than a base portion of the article such that a void exists between the neck portions of adjacent articles. This void allows a user access to portions of the handle aperture disposed between an adjacent pair of articles located in cells on opposing sides of the medial partition structure.

It can be appreciated that various changes may be made within the scope of the present invention. For example, the size and shape of the panels and apertures may be adjusted to accommodate articles of differing size or shape. The carrier may be configured and arranged to package a different number of articles. In such embodiments the carrier may comprise an alternative number of partition structures so as to separate adjacent articles. In the first illustrated embodiment, the side and end walls 20, 22, 16/18, 24/26 are substantially of the same height as the bottles contained within the carrier. In other embodiments, a top cover may additionally be applied to the carrier to more fully enclose the tops of the articles, albeit utilising the recess for accessing the carrying handle. In yet other embodiments, the side and end walls 20, 22, 16/18, 24/26 are not substantially of the same height as the bottles contained within the carrier.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cut line, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. An article carrier, comprising:

a tubular structure having a plurality of outer walls defining an interior volume for receiving one or more articles;

a medial partition structure coupled to the tubular structure; and a carrying handle formed in the medial partition structure, the carrying handle having an engaging edge, the engaging edge being disposed in an off-centre position within the medial partition structure and the engaging edge being disposed at a non-zero angle relative to an upper edge of the medial partition structure;

wherein the carrying handle comprises at least one aperture which defines said engaging edge, and wherein a first notional line passing through the center of said at least one aperture is spaced from a second notional line passing through a center of the medial partition structure such that the engaging edge is disposed in said off-centre position within the medial partition structure;

wherein the carrier comprises a bottom wall, and wherein the first and second notional lines each run in a perpendicular manner to the bottom wall; and wherein the at least one aperture is dimensioned such that the second notional line also passes through an end region of the at least one aperture, wherein said end region is disposed entirely within said at least one aperture.

2. The article carrier according to claim 1 wherein the plurality of outer walls comprises first and second opposed side walls and front and rear opposed end walls, and wherein a first end of the carrying handle is closer to the front end wall than a second end of the carrying handle is to the rear end wall.

3. The article carrier according to claim 2 wherein, the medial partition structure has an end-to-end length and wherein the distance between the first end of the carrying handle and the second end of the carrying handle is between about 40% and about 45% of the end-to-end length of the medial partition structure.

4. The article carrier according to claim 3 wherein, a first distance between the front end of the carrier and the first end of the carrying handle is between about 10% and about 15% of the end-to-end length of the medial partition structure.

5. The article carrier according to claim 3 wherein, a second distance between the rear end of the carrier and the second end of the carrying handle is between about 40% and about 45% of the end-to-end length of the medial partition structure.

6. The article carrier according to claim 5 wherein the second distance is about 45% of the end-to-end length of the medial partition structure.

7. The article carrier according to claim 3 a third distance between the second notional line and the first notional line is between about 10% and about 15% of the end-to-end length of the medial partition structure.

8. The article carrier according to claim 7 wherein the third distance is 13% of the end-to-end length of the medial partition structure.

9. The article carrier according to claim 1 wherein the non-zero angle at which the engaging edge of the carrying handle is disposed, relative to the upper edge of the medial partition structure is between about 5° and about 15°.

10. The article carrier according to claim 9 wherein the non-zero angle is 10°.

11. The article carrier according to claim 1 wherein the medial partition structure is arranged to divide the interior of the carrier into at least two cells.

12. The article carrier according to claim 11 wherein the carrying handle comprises a handle aperture extending through medial partition structure, the handle aperture having a first and second end and wherein the partition structures comprises a first pair of cells for receiving a respective one of a first pair articles and a second pair of cells for receiving a respective one of a second pair articles, the first pair of cells being disposed at an end of the article carrier and the second pair of cells disposed adjacent to the first pair of cells, and wherein the handle aperture is arranged to be disposed between the first pair of articles and between the second pair of articles and extends therebetween.

13. The article carrier according to claim 1 wherein the carrier comprises partition structures and wherein the interior volume is divided into separate cells created by the partition structures, which partition structures mitigate against the articles contained within the carrier from colliding into one another.

14. The article carrier according to claim 1 wherein the carrying handle comprises one or more cushioning flaps foldably connected to the carrying handle and wherein at least one cushioning flap is foldably connected along the engaging edge to provide a cushion against which a user's fingers more comfortably contact the carrying handle when the carrying handle is deployed.

15. The article carrier according to claim 1 wherein the carrying handle is sufficiently large such that at least three of a user's fingers can be inserted into the carrying handle and wherein the medial partition structure comprises only one such carrying handle.

16. A blank for forming an article carrier, the blank comprising:

a plurality of panels for forming a plurality of outer walls of a tubular structure of the carrier;

one or more panels for forming a medial partition structure, which one or more panels are configured and arranged such that once the blank is assembled into a carrier, the medial partition structure is connected to the tubular structure; and wherein the one or more panels for forming a medial partition structure comprise handle features for forming a carrying handle in the medial partition structure, the features for forming a carrying handle being configured and arranged such that the carrying handle of the carrier formed from the blank has an engaging edge that is disposed at a non-zero angle relative to an upper edge of the medial partition structure and wherein the engaging edge is disposed in an off-centre location within the medial partition structure;

wherein the carrying handle comprises at least one aperture which defines said engaging edge, and wherein a first notional line passing through the center of said at least one aperture is spaced from a second notional line passing through a center of the medial partition structure such that the engaging edge is disposed in said off-centre position within the medial partition structure;

wherein the blank comprises a panel for forming a bottom wall in a set-up carrier, and wherein the first and second notional lines each run in a perpendicular manner to the bottom wall in the set-up carrier; and wherein the at least one aperture is dimensioned such that the second notional line also passes through an end region of the at least one aperture, wherein said end region is disposed entirely within said at least one aperture.

* * * * *